US005807171A

United States Patent [19]

Felsen

[11] Patent Number: 5,807,171

[45] Date of Patent: Sep. 15, 1998

[54] AIR DIFFUSER APPARATUS

[75] Inventor: Karl H. Felsen, Winnipeg, Canada

[73] Assignee: E.H. Price Limited, Winnipeg, Canada

[21] Appl. No.: 665,265

[22] Filed: Jun. 17, 1996

[51] Int. Cl.[6] ..... F24F 13/06

[52] U.S. Cl. ..... 454/296; 454/302

[58] Field of Search ..... 454/292, 296, 454/298, 297, 302

[56] References Cited

U.S. PATENT DOCUMENTS

| | | | |
|---|---|---|---|
| 2,369,119 | 2/1945 | Dauphines | 454/302 |
| 2,858,760 | 11/1958 | Lathrop | 454/302 |
| 3,001,464 | 9/1961 | Moore . | |
| 3,319,558 | 5/1967 | Bodian . | |
| 4,181,253 | 1/1980 | Barlow | 454/302 X |
| 4,726,285 | 2/1988 | Kelley . | |
| 4,876,949 | 10/1989 | Fairchild et al. | 454/296 |
| 5,016,525 | 5/1991 | Weck . | |
| 5,054,379 | 10/1991 | Sodec . | |
| 5,107,755 | 4/1992 | Leban et al. | 454/302 |
| 5,259,817 | 11/1993 | Schumacher et al. | 454/296 |
| 5,584,761 | 12/1996 | Locker | 454/302 |

OTHER PUBLICATIONS

Titus Cold Air Perforated Diffuser, Model PSS–LT, p. 4.
Titus Model OMNI–LT, High Induction, p. 6.
Titus Model HI–LT, High Induction, p. 8.

*Primary Examiner*—Harold Joyce
*Attorney, Agent, or Firm*—Ridout & Maybee

[57] ABSTRACT

An air diffuser apparatus has a box-like air diffuser chamber with sheet metal side walls, that are provided with a series of laterally spaced outlet orifices. Each orifice is formed by cutting out wing portions of the sheet metal on each side of a center line of the orifice and bending the wing portions outwardly to a position inclining toward this center line. The wing portions define an air flow passage tapering in an outward direction. The chamber has a base connected to a lower edge of the side walls that includes a layer of heat insulation material. An upper structure closes the upper end of the chamber and has an inlet opening for introducing pressurized low temperature air into the chamber. This arrangement is highly efficient for diffusion of low temperature air and can be of essentially all-metal construction.

14 Claims, 7 Drawing Sheets

AIR DIFFUSER APPARATUS

The invention relates to air diffuser apparatus especially although not exclusively adapted for introducing low temperature air into a space to be air conditioned. The diffuser apparatus may also be used for distribution of heated air from an HVAC system.

Traditional air conditioning systems have often relied on delivery of air that has been cooled to a modest extent relative to ambient conditions, at high volume flow rates. Typically, the cooled air is at a temperature of about 55° to 59° F., (12.5° C. to 15° C.), and such air has to be delivered at relatively high flow rate because intrinsically it has small cooling capacity. More recently, low temperature air delivery systems have been developed. These supply much colder air, typically at a temperature of less than 50° F. (10° C.) and more usually less than 40° F. (4.5° C.). Cold primary air temperatures as low as 35° F. (1.5° C.) may be employed.

Because of the significantly greater cooling capacity of the low temperature air, lower volume flow rates may be employed, and this is reflected in a reduction in the size of the air handling and distribution apparatus throughout the mechanical system, including chillers, pumps, condensers, piping, fans, air mixing units and duct work. Such equipment downsizing results in lower building noise, reduced building heights due to space gains, and significant cost savings.

In order to prevent condensation, all surfaces of the air delivery system which may be cooled below the ambient dew point have to be well insulated and sealed. This includes the surfaces of all air handling units, ducts, terminals, and of the air outlets or diffusers that deliver the lower temperature air into the space to be air conditioned.

Further, since the lower temperature air is denser than and typically supplied at lower velocities than conventional systems, diffuser performance is affected. The diffusers throw is reduced and dumping of cold air downwardly from diffusers adjacent the ceiling may occur at low load conditions. Short throws of the air passing outwardly from the diffusers can lead to inadequate mixing and room air motion, resulting in thermal stratification and stagnant zones. Downward dumping of cold air or excessively rapid drop of the cold air from the diffuser may result in unacceptable drafts in the occupied zone. conventional air diffuser apparatus therefore generally does not operate satisfactorily with low temperature air, and various forms of low temperature air diffuser apparatus have been proposed to overcome these problems. Generally, the known low temperature air diffusers of which applicant is aware have employed air discharge nozzles which are elongated and tubular or are in the form of tubular bores. The known apparatus of which applicant is aware is relatively expensive to manufacture and the known designs do not offer flexibility of design and ease of modification for differing cooling locations or environments Further, the efficiency and performance of the known diffuser apparatus is not always as great as is desired.

In the present invention there is provided air diffuser apparatus (termed the induction chamber) comprising a box-like air diffuser chamber comprising: (a) sheet metal side walls provided with a series of laterally spaced outlet orifices each formed by cutting out wing portions of the sheet metal on each side of a center line of the orifice and bending the wing portions outwardly to a position inclining toward an axial center line of the orifice, whereby the wing portions define a jet-like flow passage tapering in an outward direction, (b) a base connected to a lower edge of the side walls comprising a layer of heat insulation material; and (c) an upper structure closing the upper end of the chamber and providing an inlet opening for introduction of pressurized low temperature air into the chamber.

It has been found that the arrangement of the invention is highly efficient in converting a pressurized air supply to a high velocity air stream which causes a high rate of induction of warm room air, providing extended throw of low temperature air along the underside of a ceiling or like surface, and without undesired sinking or downward dumping of cold air occurring even at conditions of relatively low air flow. Further, the arrangement has excellent acoustical properties and provides low pressure drops. The diffuser may comprise an essentially all-metal construction and may he fabricated relatively inexpensively and is highly durable.

The invention is illustrated in more detail, by way of example only, in the accompanying drawings.

Figure 8:
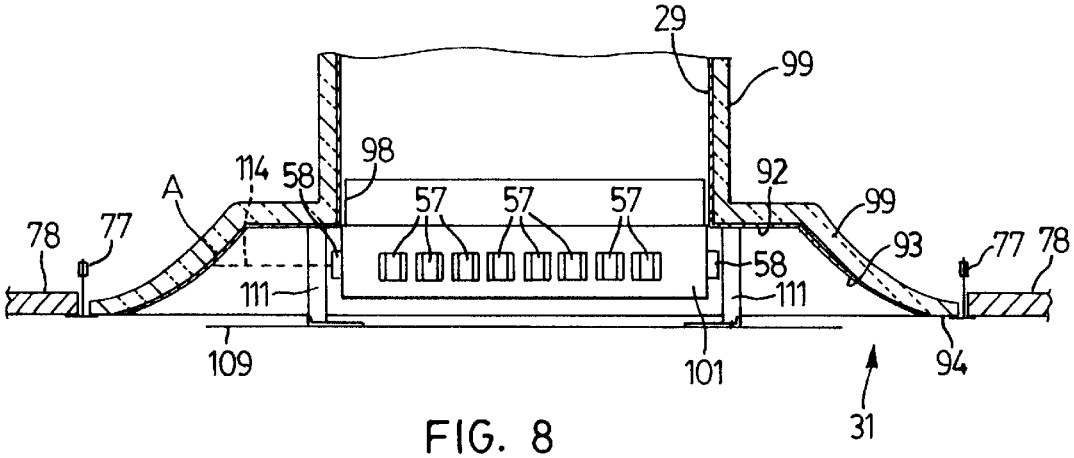
FIG. 8 is a side view partially in section of the diffuser apparatus of FIG. 7.
Figure 14:
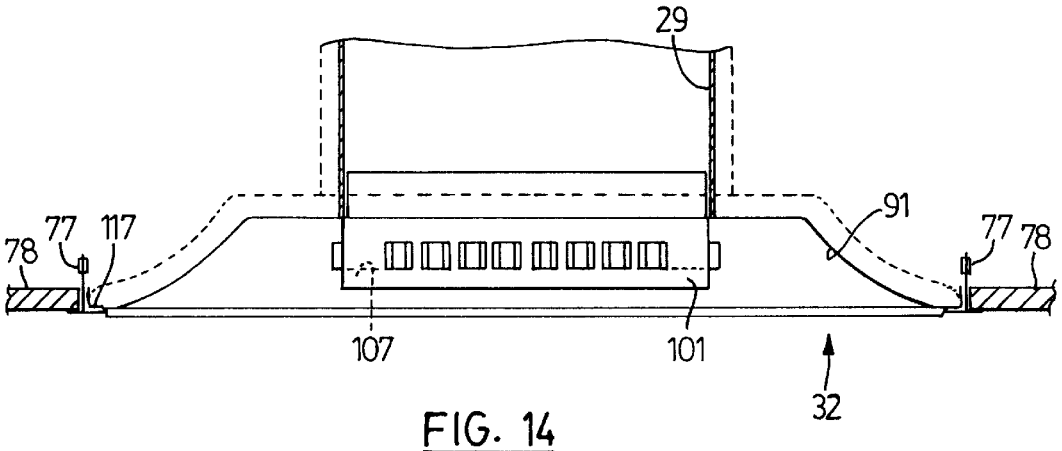
Figure 10:
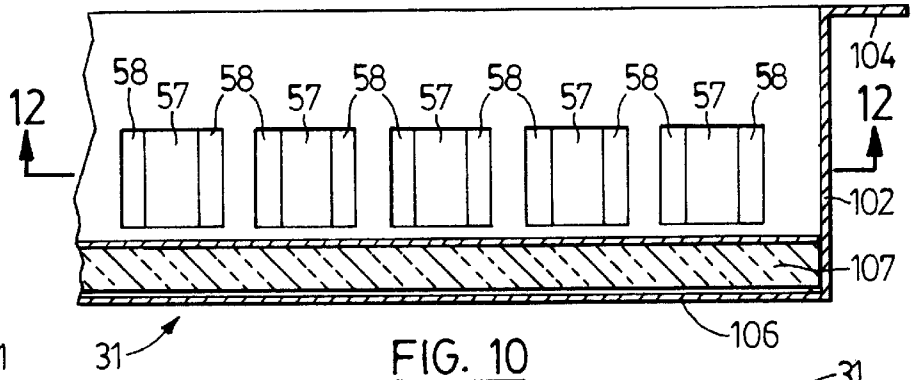
FIG. 10 shows a transverse cross-section taken on the line 10—10 in FIG. 11.
Figure 13:
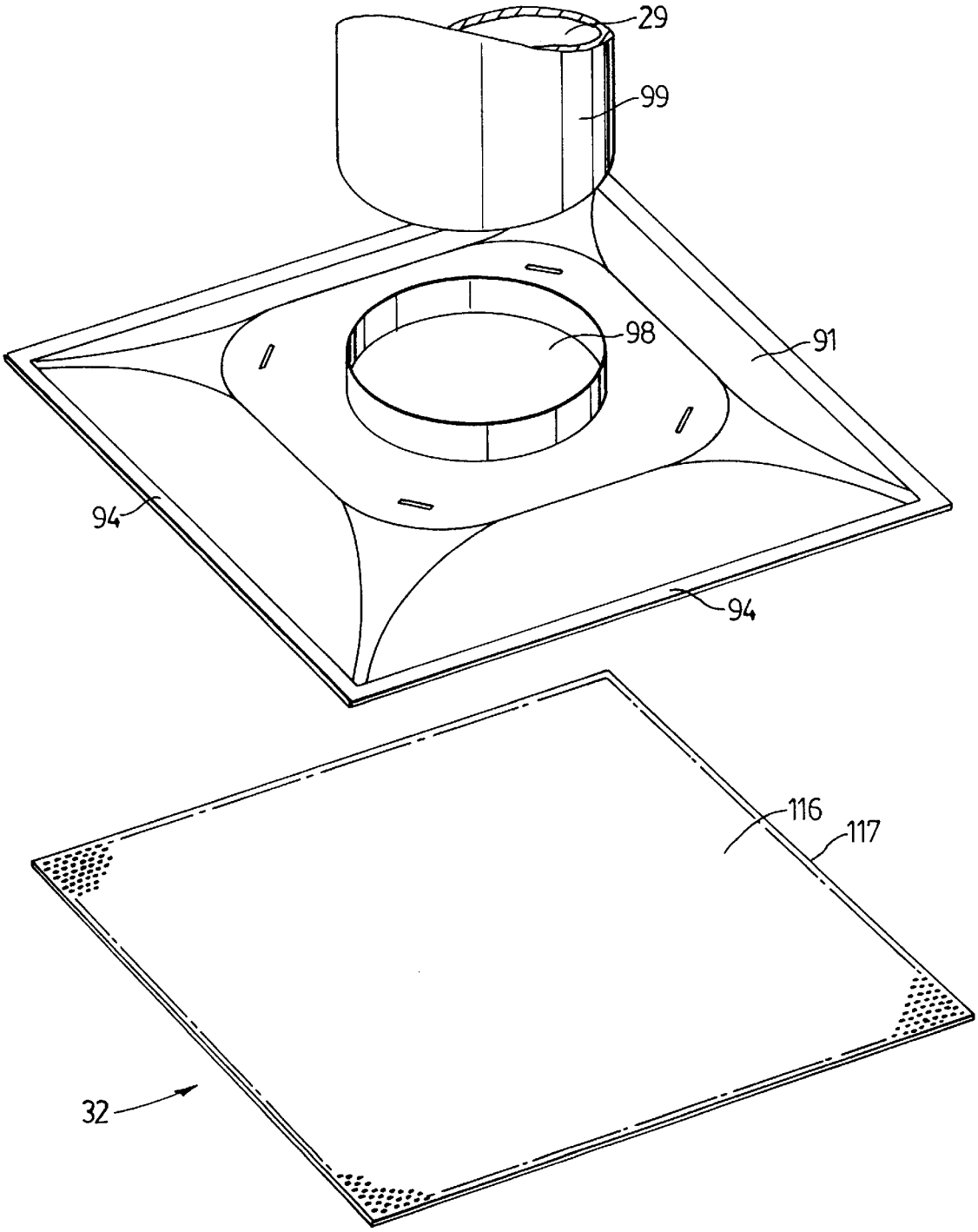
FIG. 13 is an exploded partial isometric view of a modified form of the diffuser apparatus of FIG. 7.

FIG. 14, which appears on the same sheet as FIG. 8, is a side view partially in cross section of the diffuser apparatus of FIG. 13.

Figure 1:
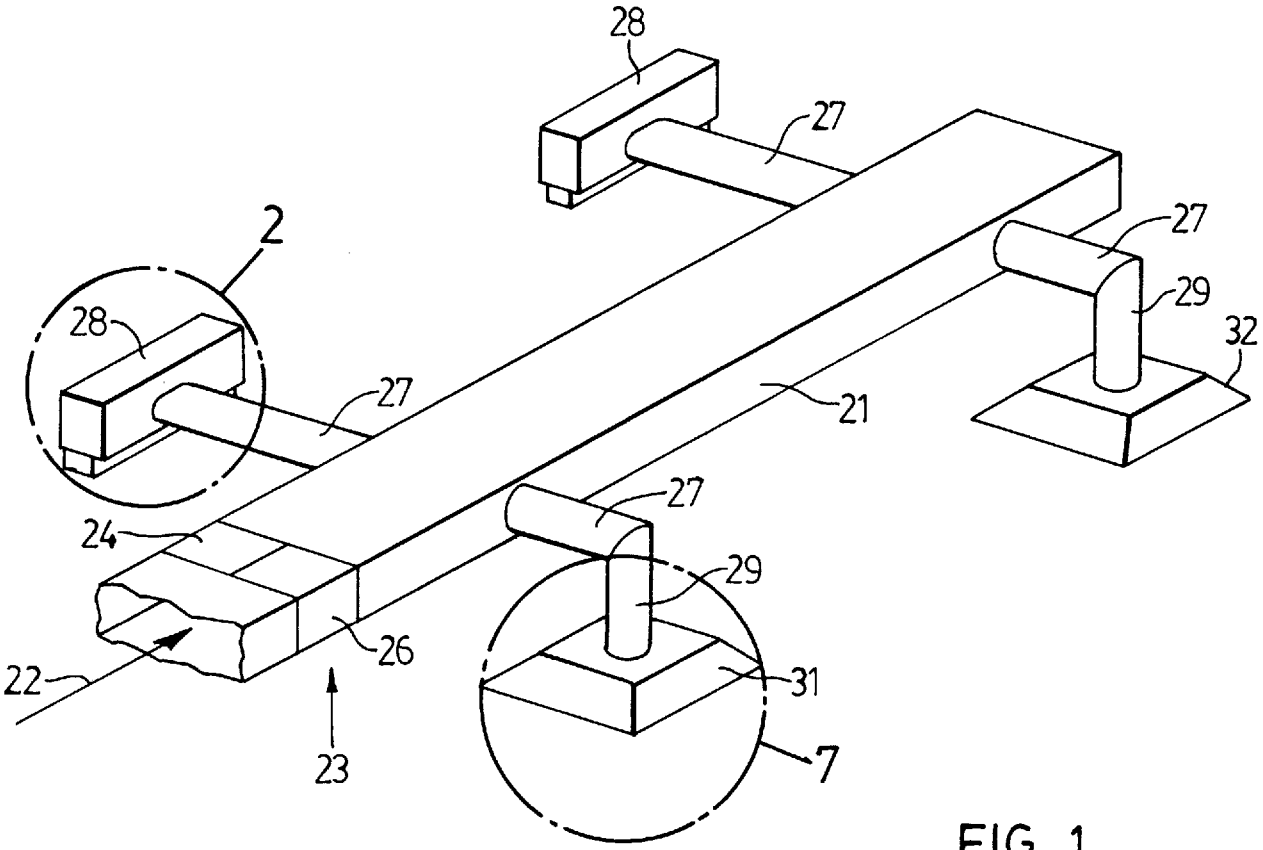
FIG. 1 is an isometric view showing somewhat schematically a heating, ventilating and air conditioning system employing diffuser apparatus in accordance with the invention .

Referring to the drawings, wherein like reference numerals indicate like parts, FIG. 1 shows somewhat schematically an air distribution system which may be mounted, for example, on and within a suspended ceiling installation.

The distribution system comprises a main air duct 21 along which pressurized air is supplied in the direction of the arrow 22 and passes through a temperature control station 23 wherein the air may be heated and/or cooled by heating and cooling devices 24 and 26. In a typical air conditioning system, the air passing through the duct 21 after the temperature control station 23 may be at a temperature of, for example, about 42° F. to 47° F. (6° to 8° C.).

Figure 12:
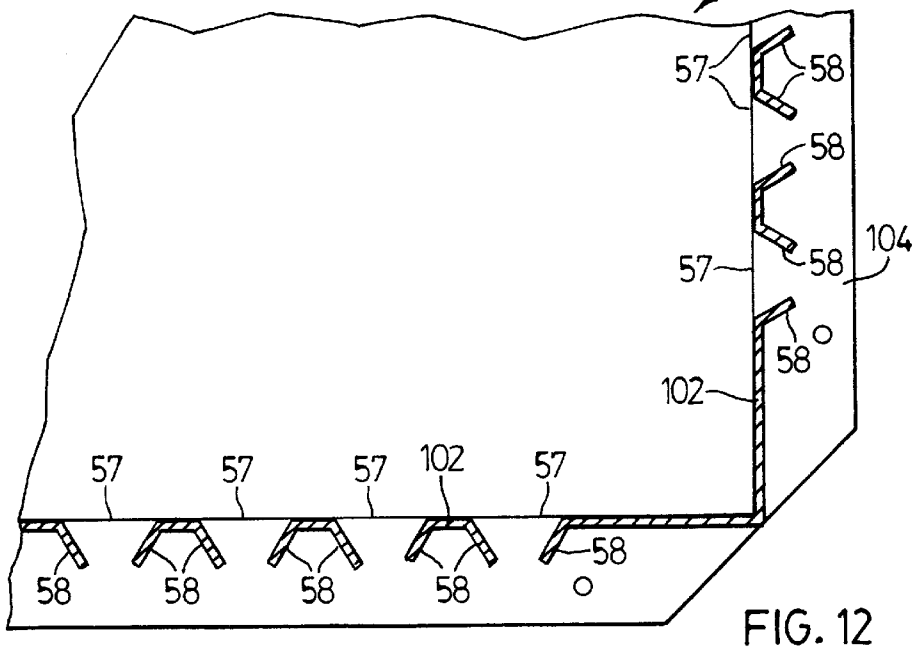
FIG. 12 is a plan view taken on the line 12—12 in FIG. 10.
Figure 9:
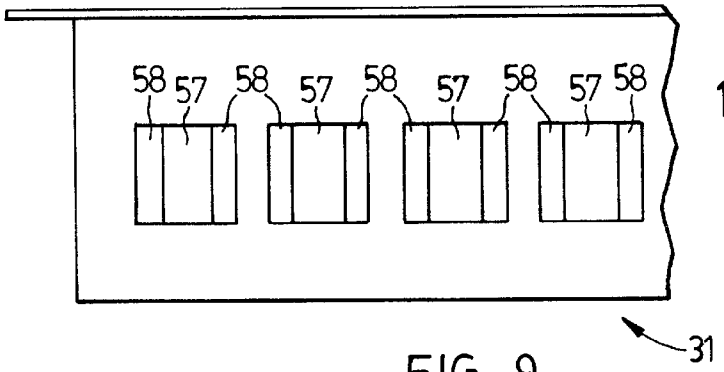
FIG. 9 is a partial side view taken on the line 9—9 in FIG. 7.
Figure 11:
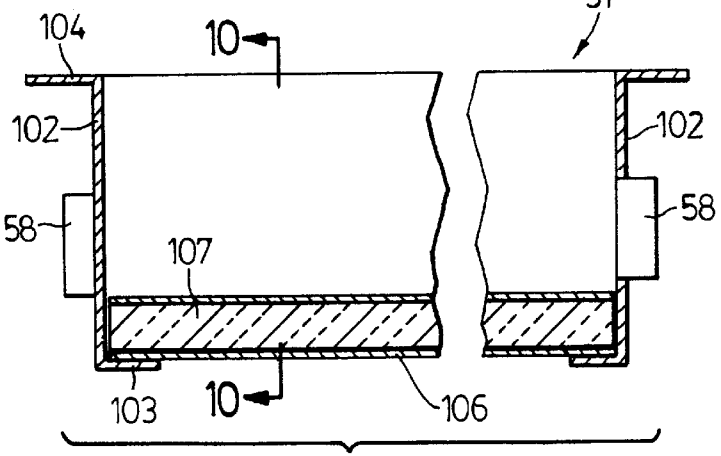
FIG. 11 is a partial vertical cross-section taken at right angles to the cross-section of FIG. 10.

Lateral distribution ducts 27 communicate with the main duct 21. In the example illustrated, the ducts 27 on one side each communicate with a linear diffuser device 28 as shown in more detail in FIGS. 2 to 6. On an opposite side, the ducts 27 communicate with vertical ducts 29 connecting to a square plaque diffuser 31 as shown in more detail in FIGS. 7 to 12 or to a perforated diffuser 32 as shown in more detail in FIGS. 12 and 13.

Referring to FIGS. 2 to 6, the linear diffuser 28 as shown is designed to distribute low temperature supply air to spaces that require linear air distribution patterns such as perimeter areas or large open interior zones.

The diffuser 28 comprises an upper air plenum chamber 23 and a lower air induction chamber 34.

The plenum chamber 33 is in the form of a metal box with an open bottom, and comprises a metal top 36, sides 37 and 38 and ends 39, all of which are lined with an air and vapor impervious thermal blanket or insulation material 41. The insulation material 41 may, for example, comprise a fibrous insulation material, for example dual density fiberglass insulation material, faced with an air and vapor impervious aluminium foil facing 42. One side 37 of the box-like chamber 33 is formed with a round or oblong opening 43 which may be provided with a collar 44 to assist in forming an air tight connection to the duct 27, and through which air is passed into the interior of the chamber 33 from duct 27. The bottom of the chamber 33 is formed with a large rectangular opening 46 bordered by flanges 47 connected to the side walls 37 and 38.

The collar 44, bottom flanges 47, side wails 37 and 38, ends 39 and top 36 may all comprise sheet metal, for example sheet steel or aluminium, and the elements may be spot welded together, The induction chamber 34 is generally trough-like in shape and is applied on the bottom surface of the flanges 47 to receive air passing downwardly through the opening 46.

Figures 3, 4, 5, 6:
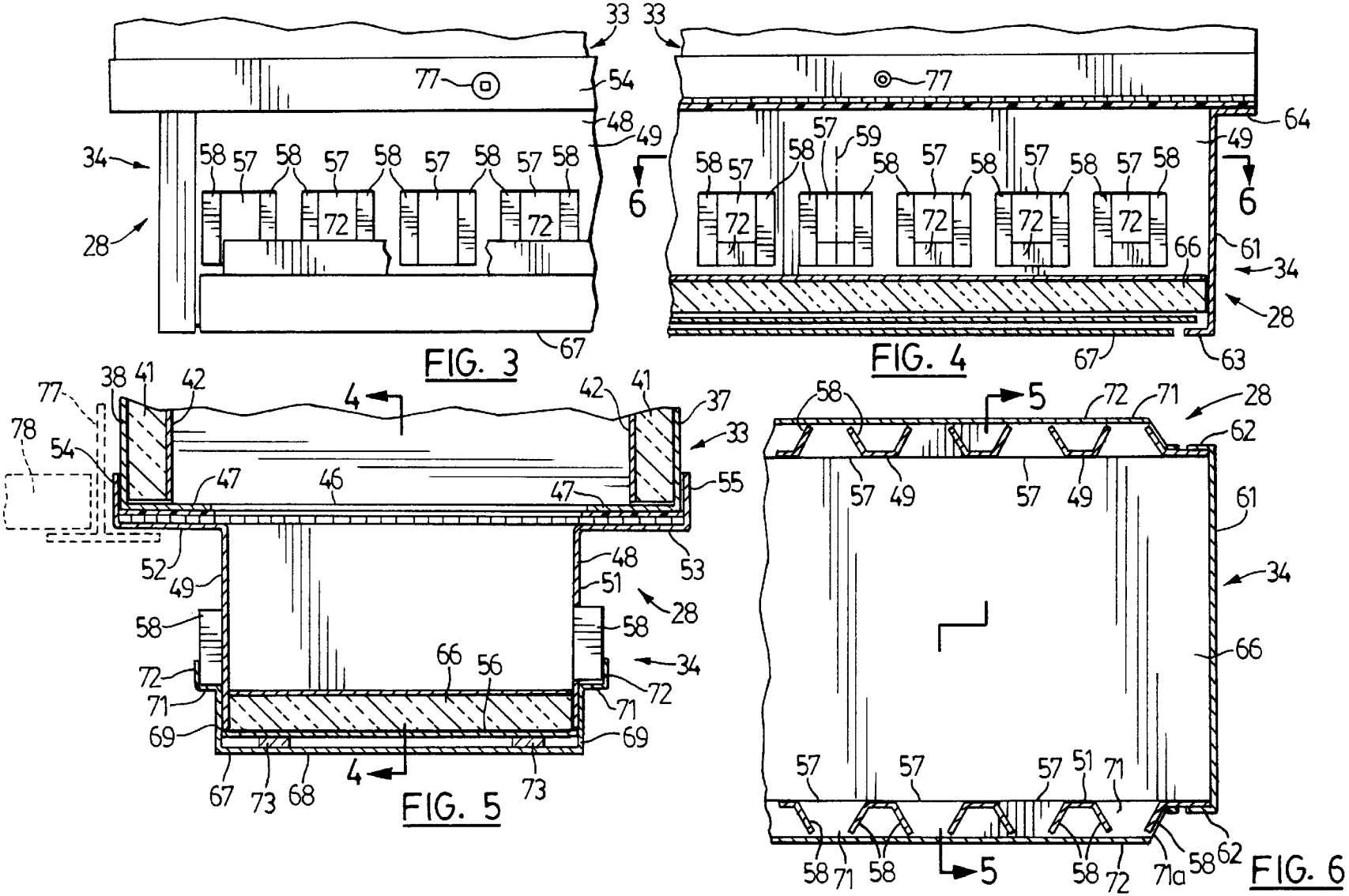
FIG. 3 is a side view of the diffuser apparatus taken on the line 3—3 in FIG. 2.
FIG. 4 shows a vertical longitudinal cross-section through the diffuser apparatus taken on the line 4—4 in FIG. 5.
FIG. 5 shows a transverse vertical cross-section taken on the stepped line 5—5 in FIG. 6.
FIG. 6 is a horizontal cross-section taken on the line 6—6 in FIG. 4.

The chamber 34 comprises a trough-like sheet metal member having opposing side walls 49 arid 51 connected at their upper ends to respective horizontal flange members 52 and 53 from which vertical side flanges 54 and 55 extend upwardly. The spacing between the flanges 54 and 55 is such as to snugly receive the sides 37 and 38 of the plenum chamber box 33. The lower ends of the side walls 49 and 51 are connected by a bottom 56. The sheet metal of the sides 49 and 51 is formed by a metal fabrication process to provide these sides with a series of outlet orifices 57 disposed in a horizontal linear array and each having a wing portion 58 on each side directed outwardly and inclining toward a centre liner for example a vertical centre line 59 as shown in FIG. 4 of each orifice. The metal fabrication procedures necessary for forming the orifices 57 and wing-like projections 58 are readily understood by those skilled in the art and need not be described in detail. Briefly, however, it may be mentioned that each opening may be formed by first punching an I-shaped opening in the metal, cutting through the metal along the upper and lower margins forming the orifice 57 and lancing or bending out the wing portions 58 to their inclined positions as best seen, for example, in FIG. 6. The orifices 57 and wing portions 58 form in effect tapered metal air discharge slots. It has been found that these tapered slots in the configuration shown efficiently convert static pressure to high velocity flow causing a high rate of induction of room air and rapid mixing of the room air with low temperature air supplied to the interior of the induction chamber.

The induction chamber also comprises sheet metal end caps 61 that close the ends of the trough-like chamber 34. Each end cap 61 has side walls 62 that receive the side walls 49 and 51 on their inner sides, and a bottom wall 63 that receives the bottom wall 56 of the trough. The end cap 61 may be spot welded to the walls 56, 49 and 51. Each end cap also includes an upward horizontal flange portion 64 extending horizontally between the flange portions 52 and 53. Further, a gas and vapour tight plate-like insulation material barrier 66, which may be similar to the foil faced material 41 used within the plenum chamber 33, is adhered to the inner side of the bottom wall 56. The insulation material 66 and end caps 61 render the induction chamber 34 air tight against leaks outwardly except through the orifices 57.

Figure 2:
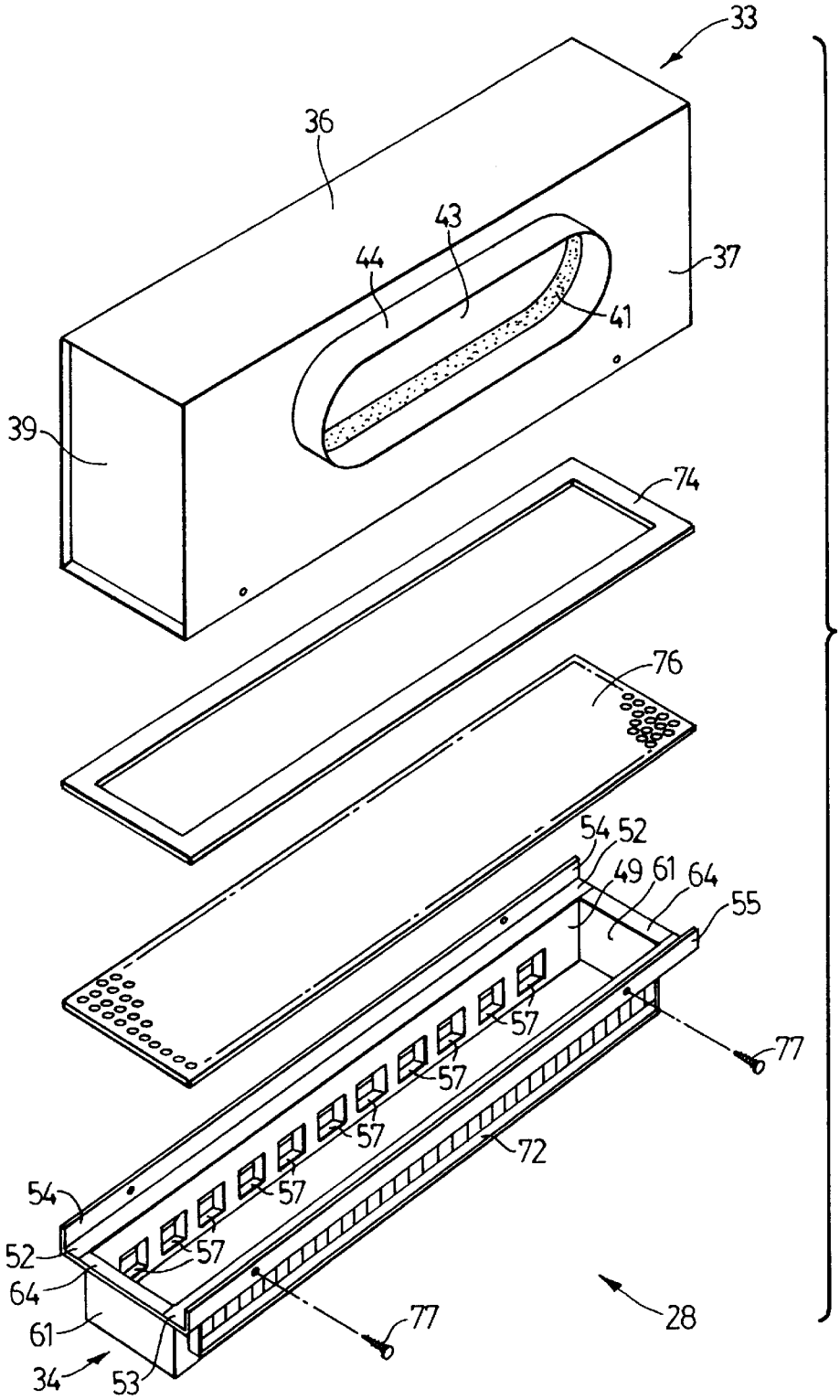
FIG. 2 is a partially exploded isometric view showing elements of a diffuser apparatus of the kind circled at 2 in FIG. 1.

A secondary trough-shaped sheet metal air deflector member 67 formed for example of coated steel or aluminium is applied on the underside of the lower wall 56 of the air induction chamber. As best seen in FIGS. 3 and 5, this trough shaped member 67 comprises a bottom wall 68, side walls 69 and L-shaped upper edge portions on the upper edge of each side wall 69, formed by horizontal flange portions 71 and vertical or upwardly extending flange portions 72 on an outer edge of portions 71. As seen in FIGS. 2, 3 and 6, the L-shaped deflector portion 71 and 72 runs along the length of the array of orifices 57 with the wall 72 extending part way over the height of the orifices 57 and disposed outwardly from and in horizontal register with the lower portion of each of the orifices 57. The L-shaped flange 71 and 72 functions as an anti-dump deflector, to avoid any tendency for cold air to be dumped downwardly from the orifices 57, especially at lower air flow rates.

As seen in FIGS. 3 and 6, the vertical flange portion 72 may terminate adjacent the outer wing 58 of the end most orifice 57 of the linear array, and the horizontal flange portion 71 is bevelled at each end 71*a* approximately flush with the adjacent wing portion 58.

The trough shaped member 57 is adhered to the lower side of the bottom wall 56 of the induction chamber 34 with double sided adhesive tape strips 73. The double faced tape 73 and the air space between the walls 56 and 68 provides a thermal break to avoid any risk of condensation from forming on the lower surface of the diffuser 28.

In assembling the induction chamber 34 to the plenum chamber 33, a resilient rectangular sealing gasket 74, for example of neoprene rubber, is applied to the lower side of the flanges 47 of the plenum chamber box 33, and a perforated air distribution plate 76 is applied on the gasket 74. The plate 76 may be a met al, for example aluminium plate, provided with a series of closely spaced perforations and is intended to offer some desistance to air flow and serve to distribute the air more evenly along the length of the trough-shaped induction chamber 34, so that all the orifices 57 along the length of the trough are supplied with similar pressure air.

The trough-shaped induction chamber 34 is applied to the assembly of the box 43, gasket 74 and plate 76, and is held in place with, for example, screws or like fasteners 77 applied through holes in the upper vertical side walls 54 and 55 and received in corresponding holes in the side walls 37 and 38 of the upper plenum chamber 33.

In use, usually the linear air diffuser is installed with the upper plenum chamber 33 disposed within a ceiling space and the lower diffuser portion 34 protruding downwardly below the ceiling. For example FIG. 5 shows installation in a conventional suspended ceiling arrangement, wherein the lower edge of the plenum chamber 33 is aligned with the ceiling structure comprising conventional T-bars 77 and ceiling tiles 78, shown in broken lines in FIG. 3.

The main duct 21 and the lateral ducting 27 connected to the diffusers 28 are provided with insulation blankets and vapour barriers to prevent condensation in the unconditioned plenum space above the ceiling and all connections between the ducting elements 21 and 27 and to the diffusers 28 are sealed tightly. The materials and procedures suitable for effecting the insulation and sealing are in themselves known to those skilled in the art and need not be described herein.

Low temperature air supplied along the main duct 21 and lateral ducts 27 enters the plenum chamber 33 and is distributed by the distributor plate 76 along the length of the trough-like induction chambers 34. The tapering metal slots defined by the orifices 57 and wing portions 58 effectively convert the static pressure of the low temperature air supply to high velocity air flows and cause a high rate of induction of room air and rapid mixing of the low temperature air. It has been found that the array of tapering orifices 57 as shown results in a tight horizontal air flow pattern and extended throw of the low temperature air along the underside of the ceiling structure. The primary cold air stream mixes rapidly with the warm room air and does not sink or dump downwardly into the occupied zone and provides even temperatures throughout the conditioned space without drafts being felt by the occupants of the space.

Further, the tapering metal orifices 57 as shown provide excellent acoustical performance and relatively low pressure drop.

A further advantage of the structure as shown is that it is an essentially all metal structure and may consist of, for example, aluminum or steel sheet except for the insulation and gasketing materials. The structure is economical to manufacture and is very durable, even when used for conveying heated air during a winter heating season, since use of plastic components is largely avoided, In the example shown in the drawings, air is discharged from orifices 57 on both sides of the induction chamber unit 34. If discharge of air is desired from only one side, the trough unit 34 may be fitted on the interior with a closure or blank-off strip closing the orifices 57 on one side of the unit. Such blank-off strip is preferably black in colour to provide a symmetrical appearance, since the open orifices tend to appear black or dark in color.

FIGS. 7 to 12 illustrate a ceiling mounted low temperature air diffuser for use where distribution of air is desired in four streams generally at right angles to one another along the underside of the ceiling.

Figure 7:
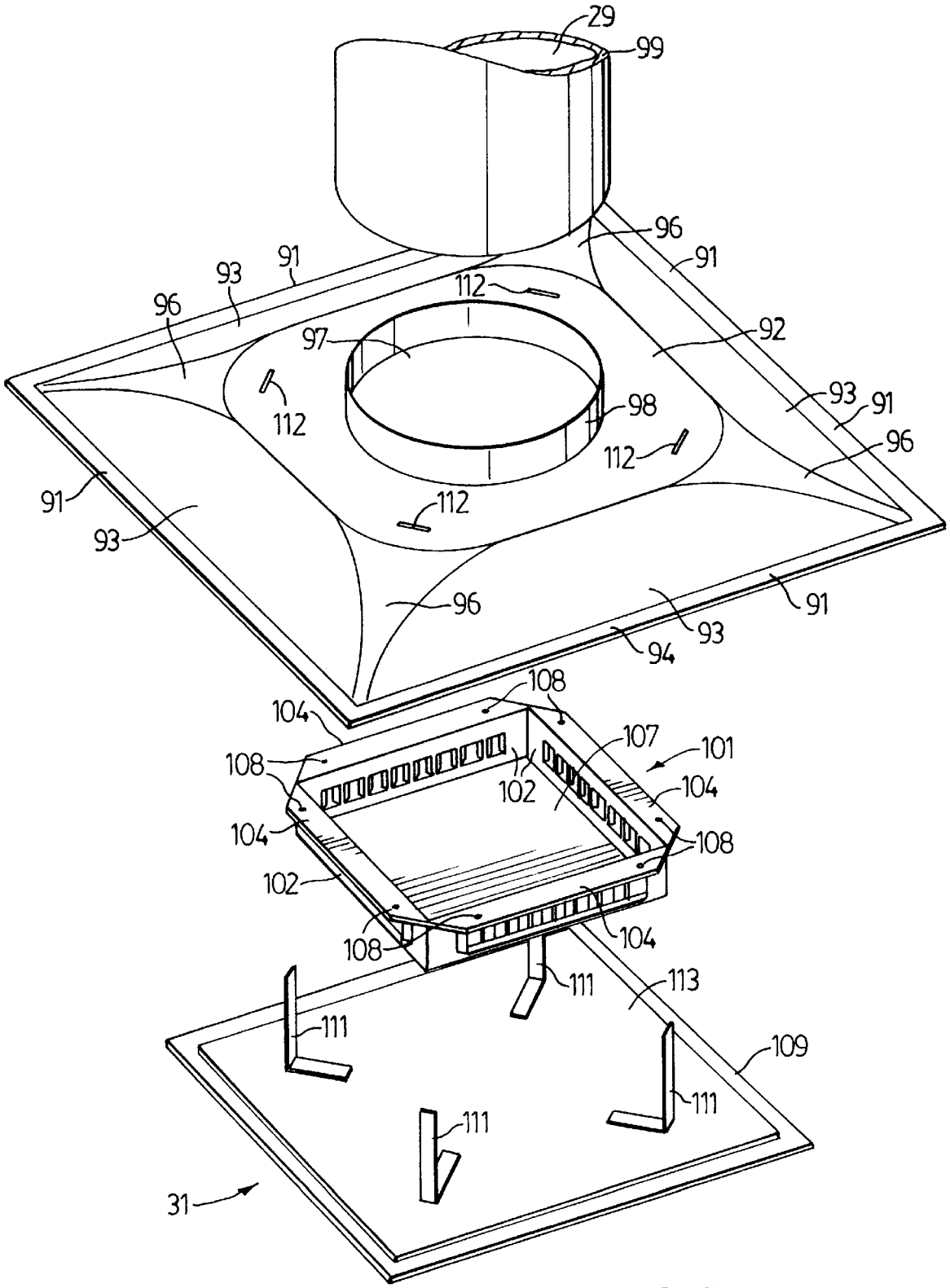
FIG. 7 is an exploded isometric view of a further form of diffuser apparatus in accordance with the invention and as circled at 7 in FIG. 1.

As seen in FIG. 7, the diffuser 31 comprises downwardly open square or rectangular air deflector element 91, usually referred to as a cone, which may in itself be of conventional form and comprises a substantially truncated pyramidal shape pressed from sheet metal. The deflector 91 comprises an upper substantially square or rectangular portion 92 with rounded corners. Connected on each side of the portion 92 is a side portion 93 inclining downwardly toward a horizontal rectangular planar edge portion 94 defining a rectangular opening. Each side portion 93 is smoothly convexly arcuately downwardly curved, and, in lateral cross section has the profile seen in FIG. 8. Between each side portion 93 is a corner portion having, when viewed in a diagonal cross-section, i.e. along a section line passing from a corner of the deflector 91 to the centre of upper portion 92, the same convexly downwardly arcuate cross-sectional profile seen for the side portions 93 in FIG. 8, and hence the portions 96 intersect with the side portions 93, edge portion 94, and upper planar portion 92 along the generally triangular boundaries seen in FIG. 7.

Air is admitted to the diffuser unit through a circular opening 96 formed in the centre of the upper portion 92 and provided with an upstanding collar 98 to facilitate air tight securement of a vertical pipe 29 to the diffuser, as seen in Fig. 8. Such diffuser pipe 29 and the rear face of the deflector 91 are provided with a gas and vapour impermeable heat insulation layer, for example foil faced fiberglass insulation material 99 as seen in FIG. 8, for example, in order to avoid any tendency for condensation on the surfaces of the deflector 91 and pipe 29 in the unconditioned plenum space.

In order to render the diffuser adapted for diffusion of lower temperature air, it is provided with an induction chamber box 101 as seen in more detail in FIGS. 9 to 12. In the preferred form, the box 101 comprises four side pieces 102 each formed from punched, lanced and bent sheet metal. Each side piece 102 is connected together at the corners of the box, for example by having overlapping edge portions spot welded together, and each comprises a vertical extending side wall 102, a lower flange 103 and an upper flange 104. A square or rectangular plate 106 forms a lower wall of the box 101 and may be spot welded to the upper sides of the flanges 103. To avoid condensation on the exterior of the lower side of the plate 106, a layer of vapour impermeable thermal insulation material, such as foil faced fiberglass insulation material 107 is disposed on the plate 106. This foil faced insulation material 107 may be similar to the materials 41 and 66 used in the linear diffuser 28 described above in more detail with reference to FIGS. 2 to 6.

Each side piece 102 is formed with a linear array of tapering metal slots formed by orifices 57 and outwardly directed inwardly inclining wing portions 58 which may be formed and as described with reference to the orifices 57 and wing portions 58 described above with reference to the diffuser of FIGS. 2 to 6. A neoprene or like resiliently deformable sheet gasket is interposed between the upper flanges of the box 101, and the box 101 is secured to the underside of the upper planar portion 92 of the deflector 91 in gas tight fashion with screws or like fasteners passed upwardly through holes 108 in the flanges 104.

To provide a still more highly advantageous air distribution pattern, the diffuser is provided with a square or rectangular horizontal plaque 109 spaced downwardly from and parallel to the plane of the arrays of orifices 57 in the box 101.

In the example illustrated, the plaque 109 is supported centrally of the air deflector 91, with its edges spared evenly from the edges 104, on L-shaped rigid legs, preferably of sheet metal, attached to the upper side of the plaque 109 and connecting to the deflector 91. In the preferred form the upper ends of the legs 111 are provided with pivotal catches (not shown) for engaging on the upper sides of slots 112 to allow assembly of the plaque 109 to the deflector 91 or disassembly therefrom for the purposes of cleaning the interior surfaces of the diffuser. Preferably, in order to avoid risk of condensation on the lower side of the plaque 109, the upper surface is provided with a layer of vapor impervious heat insulation material, such as a layer of expanded plastic material, or the like, adhered to the upper surface of the plaque. For example, the insulation material 113 may comprise a polyethylene cross-linked foam blanket 1/16 inch (1.6 mm) thick.

In use, usually the air diffuser of FIGS. 7 to 12 is installed with the edge portion 94 aligned with a ceiling surface. For example, FIG. 8 shows installation in a conventional suspended ceiling arrangement wherein the edge 94 is aligned with a ceiling structure comprising conventional T-bars 77 and ceiling tiles 78. The edge 94 may rest on a flange of the T-bars 77. Low temperature air may be supplied through the main duct 21, lateral duct 27 and vertical duct 29 to the diffuser unit 31. All connections are tightly sealed and all surfaces within the plenum space above the chamber are thermally insulated. The lower temperature air exiting the tapering slot-like orifices 57 efficiently cause induction of warmer room air and rapid mixing with the lower temperature air. The air flow outwardly from the orifices 57 is in the form of tight thin horizontally extending jets. These jets radiate outwardly in tour directions from the diffuser along the axes of the four faces 102 of the induction chamber 101. It may be noted that, in the preferred form, as seen in FIG. 8, the edge of the plaque 109 is approximately in vertical register with the point A where a horizontal projection shown in broken lines at 114 in FIG. 8 coincides with the convexly downwardly facing surface 93 of the air deflector 91. The arrangement provides for an excellent horizontal air distribution pattern outwardly along the underside of the ceiling with an absence of downward dumping of cold air even at the lower flow conditions. The downwardly convex surface 93 of the air deflector 91 provides a smoothly arcuate transition to the lower surface of the ceiling, such as the lower surface of ceiling tile 78, and it is believed the excellent air distribution properties are in part due to the Coanda effect wherein the air flow tends to cling to the surfaces of the air deflector 91 and the ceiling tile 78. The combination of the curved deflector surfaces 93 together with the horizontal plaque 109 provides particularly good air distribution. Further, the tapering air nozzles provide excellent acoustical performance and low pressure drop.

With the linear diffuser described above with reference to FIGS. 2 to 6, essentially all elements of the diffuser, except for the insulation and gasketing materials may be made of sheet metal, e.g. coated or painted sheet steel or aluminum, and may be manufactured at low cost, and provide excellent durability even where intermittently used for supply of heated air in those climates requiring heating during winter months.

FIGS. 13 and 14 show a square or rectangular perforated diffuser suitable for distribution of low temperature air comprising an air deflector element 91 and induction chamber element 101 equipped internally with insulation material 107 as described above with reference to the diffuser of FIGS. 7 to 12. The diffuser of FIGS. 13 and 14, however, is modified in that the plaque 109 and legs 111 are replaced with a perforate sheet metal face screen that occupies the entire area of the lower side of the air deflector 91 defined and bounded by the edge portion 94. The perforated sheet 116 may be, for example, sheet steel or aluminium. Again, it is found that the arrangement shown including the tapering metal slots formed by the orifices 57 and wing portion 58 efficiently cause a high rate of induction of room air and rapid mixing of the lower temperature air and provides thin horizontal air jets washing across the air deflector convex surfaces 93 and adjacent ceiling surfaces 78, and resulting in a tight horizontal air distribution pattern laterally outwardly from the diffuser and horizontally along the adjacent ceiling surfaces 78 even at conditions of reduced air flow in the supply of low temperature air through the vertical inlet duct 29. In addition to providing good air distribution, the tapering slots of the induction chamber 101 together with the perforated panel 116 provide excellent acoustical performance and low pressure drop.

Merely by way of example, the perforated plate 116 may comprise 3/16 in. (4.8 mm) diameter holes with adjacent holes staggered 60° on ¼ in. (0.6 mm) centers uniform spacing. As illustrated in FIG. 14, the marginal portion 117 of the plate may be off slightly upwardly and may rest loosely on the upper sides of flanges at T-bars 77 or the edges of the plate 116 may be connected to the edges 94 of the air deflector 91 and/or to the surrounding ceiling structure.

I claim:

1. Air diffuser apparatus comprising a box-like air diffuser chamber comprising:

(a) sheet metal side walls provided with a series of laterally spaced outlet orifices each having wing portions of the sheet metal on each side of a center line of the orifice and extending outwardly and inclining toward said center line, whereby the wing portions define air flow passage tapering in an outward direction, (b) a base connected to a lower edge of the side walls comprising a layer of heat insulation material; and (c) an upper structure closing the upper end of the chamber and providing an inlet opening for introduction of pressurized low temperature air into the chamber.

2. Air diffuser apparatus 1 wherein each orifice has a wing portion inclining inwardly from each lateral side of the orifice whereby each flow passage tapers outwardly laterally in width.

3. Air diffuser apparatus according to claim 1 wherein said upper structure comprises sheet metal and the base comprises sheet metal lined on an inner side with said heat insulation material.

4. Air diffuser apparatus according to claim 1 wherein said side walls define a generally rectangular chamber.

5. Air diffuser apparatus according to claim 4 wherein said chamber is generally square and each side wall has a plurality of said orifices spaced uniformly along it.

6. Air diffuser apparatus according to claim 4 wherein said chamber is in the form of a rectangular oblong having two major sides each having a plurality of said orifices spaced uniformly along it, and two imperforate minor sides.

7. Air diffuser apparatus according to claim 6 wherein the upper structure comprises an upper rectangular box-form sheet metal plenum chamber having a lower rectangular opening in register with an upper rectangular opening of said air diffuser chamber and sealed in air tight manner thereto, and heat insulation material lining the interior of the plenum chamber.

8. Air diffuser apparatus according to claim 7 including a perforated metal air distribution plate disposed between the plenum chamber and air diffuser chamber.

9. Air diffuser apparatus according to claim 6 including an air deflector flange adjacent each of said plurality of orifices, said flange comprising a horizontal flange portion extending outwardly along a lower edge of said orifices and a flange portion on an outer edge of the horizontal flange portion extending upwardly over a part of a height dimension of the orifices.

10. Air diffuser apparatus according to claim 1 wherein said box-like air diffuser chamber is mounted in an upper portion of a downwardly open air deflector element having smoothly convexly arcuately downwardly curved sides, the lower edges of which define a rectangular opening.

11. Air diffuser apparatus according to claim 10 having a rectangular sheet metal plague spaced downwardly from the box-like air diffuser chamber within the opening of the air deflector element.

12. Air diffuser apparatus according to claim 11 wherein said plaque has edges coinciding approximately vertically with a point of intersection of the curved side of the air deflector and a horizontal projection from the outlet orifices of the diffuser chamber.

13. Air diffuser apparatus according to claim 11 wherein the upper side of the plaque is lined with vapour impervious heat insulation material.

14. Air diffuser apparatus according to claim 10 including a perforated metal plate disposed in said rectangular opening.

* * * * *

UNITED STATES PATENT AND TRADEMARK OFFICE

CERTIFICATE OF CORRECTION

PATENT NO. : 5,807,171
DATED : September 15, 1998
INVENTOR(S) : Felsen

It is certified that error appears in the above-identified patent and that said Letters Patent is hereby corrected as shown below:

Column 3, line 18, change "oblong" to -- obround --

Signed and Sealed this

Ninth Day of March, 1999

*Attest:*

*Attesting Officer*

Q. TODD DICKINSON

*Acting Commissioner of Patents and Trademarks*